United States Patent [19]

Holzbaur

[11] 4,414,948

[45] Nov. 15, 1983

[54] APPARATUS FOR FORMING THE OPERATING MIXTURE, IN PARTICULAR FOR MIXTURE COMPRESSING INTERNAL COMBUSTION ENGINES HAVING EXTERNALLY SUPPLIED IGNITION

[75] Inventor: Siegfried Holzbaur, Stuttgart, Fed. Rep. of Germany

[73] Assignee: Robert Bosch GmbH, Stuttgart, Fed. Rep. of Germany

[21] Appl. No.: 413,305

[22] Filed: Aug. 31, 1982

[30] Foreign Application Priority Data

May 14, 1982 [DE] Fed. Rep. of Germany ..... 3218211

[51] Int. Cl.[3] ..... F02M 39/00

[52] U.S. Cl. ..... 123/452; 261/50 A

[58] Field of Search ..... 123/452–455; 261/44 A, 50 A

[56] References Cited

U.S. PATENT DOCUMENTS

| | | | |
|---|---|---|---|
| 1,379,127 | 5/1921 | Richards | 261/50 A |
| 2,236,595 | 4/1941 | Fish | 261/44 A |
| 3,953,548 | 4/1976 | Knapp et al. | 261/50 A |
| 4,175,102 | 11/1979 | Greiner et al. | 123/452 |
| 4,227,503 | 10/1980 | Wessel | 123/452 |
| 4,271,794 | 6/1981 | Knapp et al. | 123/454 |
| 4,348,999 | 9/1982 | Holzbaur | 123/452 |

*Primary Examiner*—Ira S. Lazarus
*Assistant Examiner*—Magdalen Moy
*Attorney, Agent, or Firm*—Edwin E. Greigg

[57] ABSTRACT

An apparatus is proposed which serves to form the operating mixture for internal combustion engines, in particular for mixture-compressing engines having externally supplied ignition. The apparatus includes an air measuring device having a control body, which has a circularly curved control section and an actuation section. In accordance with the forces of the air which engage the actuation section, the control body, with its control section, opens a flowthrough opening in a mixture forming section to a greater or lesser extent. The control body is rotatably supported, concentrically with a throttle valve, and is connected with a metering needle which protrudes through a metering opening, at which point a greater or lesser fuel quantity is metered in accordance with the rotational movement of the control body.

8 Claims, 6 Drawing Figures

APPARATUS FOR FORMING THE OPERATING MIXTURE, IN PARTICULAR FOR MIXTURE COMPRESSING INTERNAL COMBUSTION ENGINES HAVING EXTERNALLY SUPPLIED IGNITION

BACKGROUND OF THE INVENTION

The invention is based on an apparatus for forming an operating mixture as generally described by the preamble to the main claim. An apparatus for operating mixture formation is already known but in which the air flow measuring device and the throttle device are disposed one after another in the intake tube, requiring a relatively large amount of space.

OBJECT AND SUMMARY OF THE INVENTION

The apparatus for operating mixture formation according to the invention and having the characteristics of the main claim has the advantage over the prior art that it is very compact, and the metered fuel is ejected into the intake tube directly at the fuel metering valve.

As a result of the characteristics disclosed in the dependent claims, advantageous further developments of and improvements to the apparatus disclosed in the main claim can be attained.

It is particularly advantageous that in order to vary the fuel-air mixture, the position of the metering opening and of the metering needle of the fuel metering valve can be varied by means of an adjusting device in accordance with operating characteristics of the internal combustion engine.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
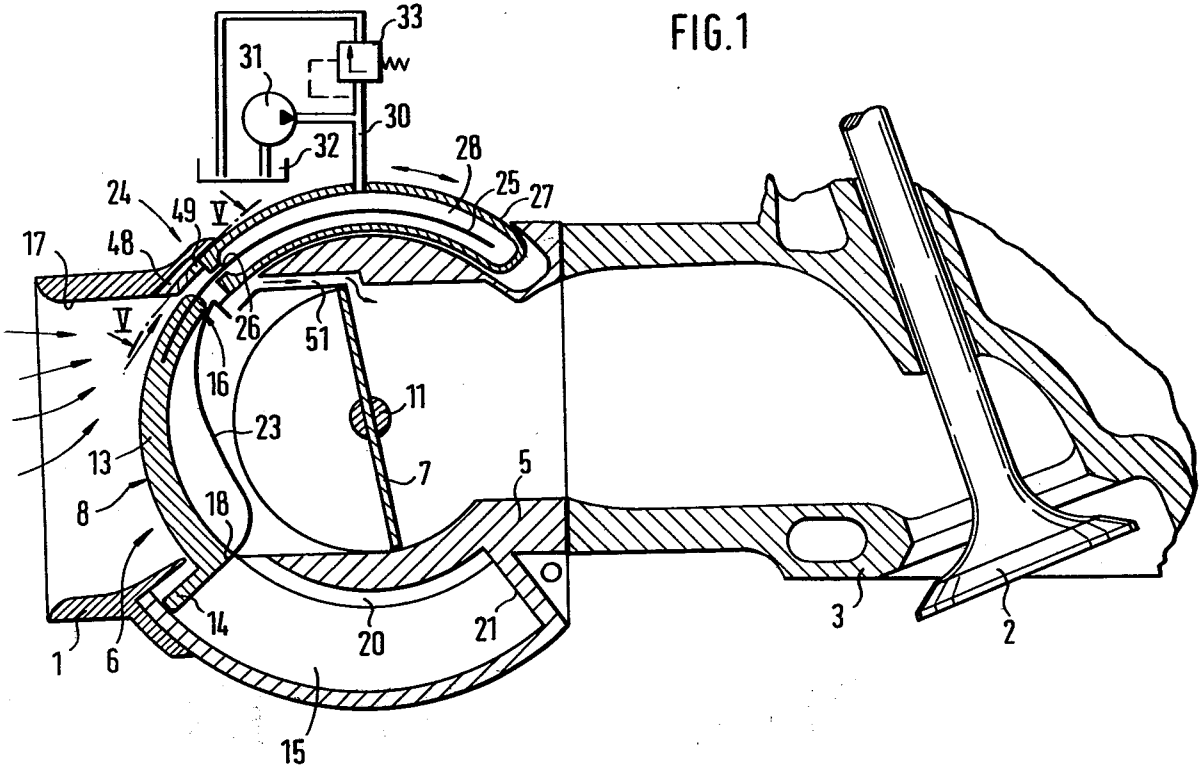
FIG. 1 shows an apparatus for forming the operating mixture in the idling position, seen in a section taken along the line I—I of FIG. 6.
Figure 4:
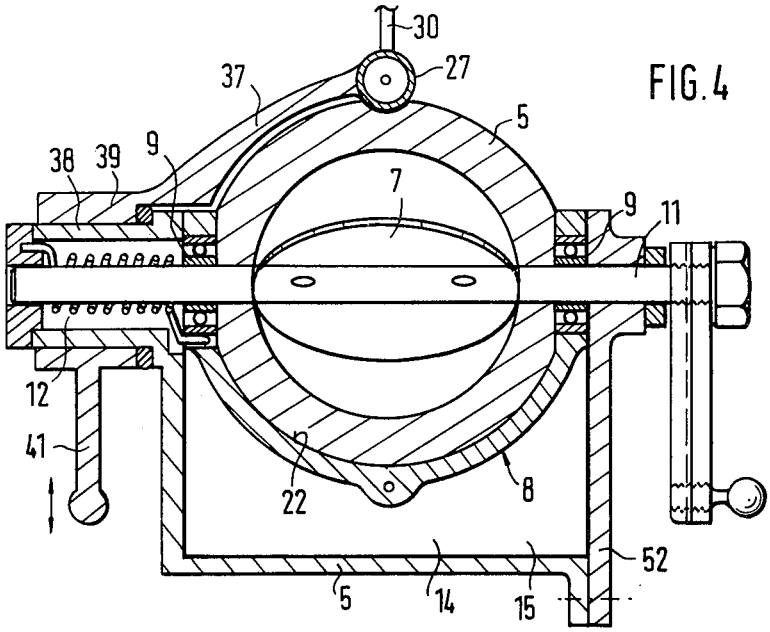
FIG. 4 is a section taken along the line IV—IV of FIG. 2.

In the apparatus for operating mixture formation shown in FIG. 1, the air for combustion flows in the direction of the arrow into an intake tube section 1, either from directly downstream of an air filter (not shown) or downstream of an intake manifold (not shown), into an individual intake tube directly upstream of an inlet valve 2 of an internal combustion engine, in particular a mixture-compressing engine with externally supplied ignition, having one or more cylinders 3. Adjoining the intake tube section 1 in the flow direction of the aspirated air is a mixture forming section 5, in which an air flow measuring device 6 and a throttle device 7, embodied by way of example as a throttle valve, are disposed. The air flow measuring device 6 has a control body 8, which as shown in FIG. 4 is rotatably supported on the throttle valve shaft 11, via ball bearings 9, coaxially with the throttle valve 7. A restoring spring 12, with one end, engages the control body 8, while the other end is held attached to the housing at the mixture forming section 5. The restoring spring 12 tends to keep the control body 8 in its position of rest; that is, the restoring spring 12 tends to rotate the control body 8 in the direction of the upper intake tube wall 17. The control body 8 has a circularly curved control section 13 and an actuation section 14, which protrudes into an actuation chamber 15 provided on the mixture forming section 5. The control section 13 of the control body 8 is embodies as circularly curved, in the form of a spherical shell or a cylindrical shell, and in its position of rest it entirely blocks the cross section of the intake tube if the throttle valve 7 is in the idling position. The more the throttle valve 7 is opened, as the quantity of air aspirated by the engine increases, the upper end 16 of the control section 13 moves farther away from the upper intake tube wall 17 and to a greater or lesser extent opens the intake tube cross section to admit the aspirated air quantity, since the forces of the air engaging the actuation section 14 effect a rotational movement of the control body 8. The actuation section 14 is disposed, by way of example, on the end 18 of the control section 13 remote from the upper end 16 and extending perpendicular thereto. In the circular actuation chamber 15, one side of the actuation section 14 experiences the air pressure in the intake tube section 1 upstream of the control section 18 and the other side experiences the air pressure downstream of the control section 13. In the wall of the actuation chamber 15, a ventilation groove 20 is provided, which enables the air pressure from directly downstream of the control section 13 to be carried as far as the fixed end wall 21 of the actuation chamber 15.

The mixture forming section 5 has a circular surface 22 oriented toward the control section 13, and this surface 22 has a flowthrough opening 23 which is open toward the intake tube section 1 and the throttle valve 7. If the control body 8 executes a rotational movement, the control section 13 opens the flowthrough opening 23 to a greater or lesser extent to admit the aspirated air. The surface 22 of the mixture forming section 5 may be embodied either cylindrically or spherically, as is shown by way of example in FIG. 6.

Figure 5:
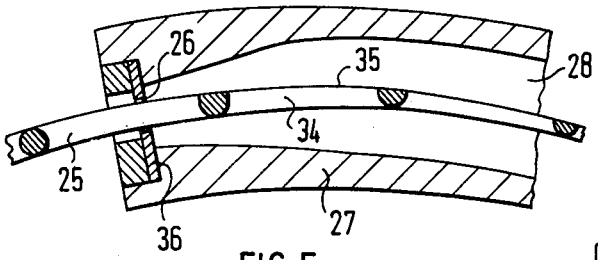
FIG. 5 is a section taken along the line V—V of FIG. 1 through a fuel metering valve seen on a different scale.
Figure 6:
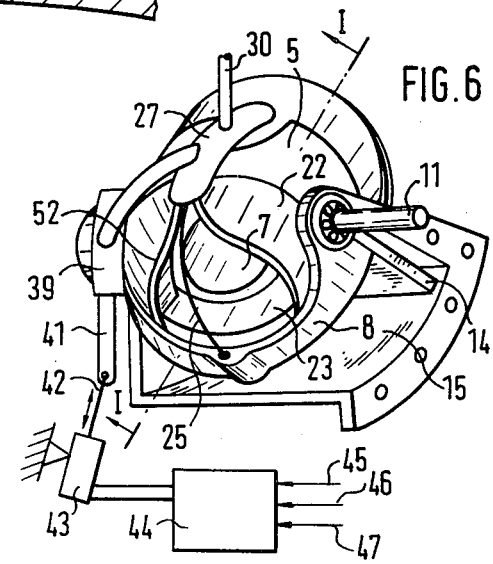
FIG. 6 shows an exemplary embodiment of an apparatus for operating mixture formation according to the invention, seen in a perspective view.

A fuel metering valve 24 is actuated directly by the control body 8, and for this purpose a circularly curved metering needle 25 is secured to the upper end 16 of the control section 13, protruding through a metering opening 26 in a shielding body 27. The shielding body 27 is disposed on the upper intake tube wall 17 and is provided with a hollow chamber 28 which extends the length thereof. The metering needle 25 protrudes into the hollow chamber 28 to a greater or lesser extent, and this chamber 28 communicates with a fuel supply line 30, into which a fuel pump 31 pumps fuel from a fuel container 32 and in which the fuel pressure can be kept constant by means of a pressure regulating valve 33. As shown in detail on an enlarged scale in FIG. 5, the metering needle 25 is fabricated of some material having a circular cross section and it has a metering zone 34, from which a greater or lesser amount of material has been removed, but only from the circumferential side 35 of the metering needle forming the curvature of larger radius; this can be seen from the representations of the metering needle cross section in FIG. 5. The metering opening 26 may advantageously be embodied in a metering disk 36, which is attached to the housing and disposed in the shielding body 27. Upon a rotation of the control body 8 in accordance with the quantity of air aspirated by the engine, the metering nozzle 25 will thus assume a corresponding position in the metering opening 26, so that a quantity of fuel corresponding to the quantity of aspirated air is metered at the fuel metering valve between the metering needle 25 and the metering opening 26. The shielding body 27 may be secured to a strut 37, which as shown in FIG. 4 is rotatably supported on a protrusion 38 from the housing of the mixture forming section 5 with a hub 39 which is coaxial with the throttle valve shaft 11. A lever 41 is also secured on the hub 39, and as shown in FIG. 6, the lever 41 engages an adjusting device 43 via an actuation member 42; the adjusting device 43 effects a rotation of the hub 39 and thus an adjustment of the shielding body 27 with respect to the metering needle 25 in accordance with operating parameters of the engine. The adjusting device 43 may, for example, be an element which functions in accordance with temperature, such as a bimetallic element or an expanding element, or it may be an electric servomotor, which is triggerable by an electronic control unit 44 into which operating parameters such as temperature 45, throttle valve position 46, exhaust gas composition 47 and others, having been converted into signals, can be fed, so that the fuel-air mixture can be varied in accordance with operating parameters of the engine.

In FIG. 1, a throttle valve 7 is shown in the idling position, in which the control section 13 virtually entirely blocks the flowthrough opening 23 for the aspirated air. The aspirated air quantity required for the mixture formation is therefore advantageously carried through an idling air conduit 48 in the upper intake tube wall 17 and then, via an opening 49 communicating with this conduit 48, meets the fuel injected between the upper end 16 of the control section 13 and the metering opening 26; the air and the fuel are then carried together via a mixture guiding conduit 51 in the wall of mixture forming section 5 toward an area downstream of the throttle valve 7. The throttle valve may be either circular or rectangular in shape.

Figure 2:
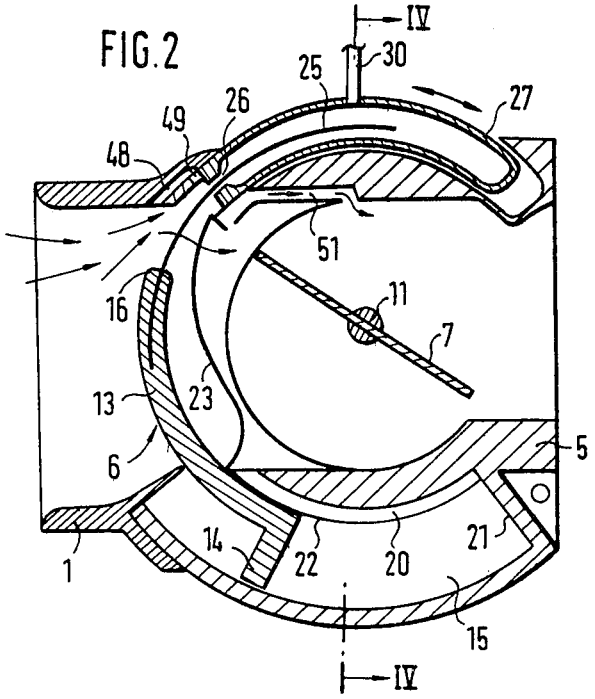
FIG. 2 shows an apparatus for operating mixture formation in the partial-load position.

In FIG. 2, the throttle valve 7 is shown in a position which it assumes when the engine is operated in the partial-load range. The upper end 16 of the control section 13 has now moved away from the upper intake tube wall 17, so that the control section 13 now protrudes only partway into the intake tube cross section and partially opens the flowthrough cross section 23; the injected quantity of fuel is carried along with the air flowing past.

Figure 3:
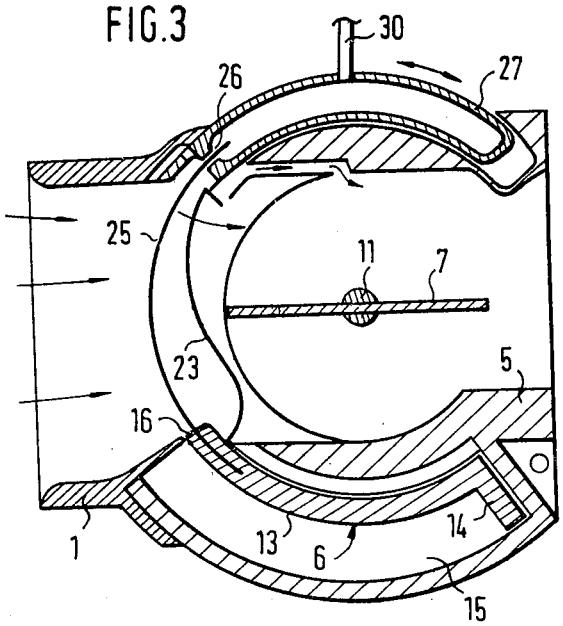
FIG. 3 shows an apparatus for operating mixture formation in the full-load position.

FIG. 3 shows the throttle valve 7 in the full-load position, in which the control section 13 opens up the intake tube cross section completely, and thus the flowthrough cross section 23 is completely opened as well.

As shown in FIG. 4, the mixture forming section 5 may have a zone with a spherical surface 22, about which the spherical-shell-like control body 8 is rotatably supported. The actuation section 14 of the control body 8, as shown by way of example, may be rectangular in shape and remote from the control section 13, so that the actuation chamber 15 likewise has a rectangular cross section, corresponding in shape to the actuation section 14.

In the perspective view shown in FIG. 6, the cover 52 which laterally defines the actuation chamber 14, and the intake tube section 1 have been removed. The throttle valve 7 and the control body 8 are shown in the full-load position, so that the flowthrough opening 23 is almost completely opened. The flowthrough opening 23 may have a contour such that a desired ratio, for instance a logarithmic ratio, exists between the rotational movement of the control body 8 and the quantity of air flowing through the flowthrough opening 23.

Embodying an apparatus for operating mixture formation in accordance with the invention makes it possible to attain a particularly small structure and assures good preparation of the fuel-air mixture delivered to an internal combustion engine.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for forming the operating mixture for mixture-compressing internal combustion engines having externally supplied ignition, said apparatus further including an air measuring device which has at least one control body arranged to block the cross section of an intake tube provided with a zone and deflectable counter to a restoring force in accordance with air flow which is controlled by a throttle device, said control body further arranged to open said intake tube cross section to a greater or lesser extent, and said deflection of said control body adapted to directly control a fuel metering valve, characterized in that said control body and said throttle device are rotably supported coaxially relative to each other and further that said control body has both a circularly curved control section which protrudes into said intake tube cross section and an actuation section having oppositely disposed surfaces, said actuation section arranged to protrude into an actuation chamber and wherein one of said oppositely disposed surfaces of said actuation section is exposed to an upstream pressure and another of said sections is exposed to a downstream pressure in said intake tube.

2. An apparatus as defined by claim 1, characterized in that said control body further includes a fuel metering needle which is arranged to move relative to a metering opening provided in a shielding body, a shielding body associated with said intake tube and said fuel metering needle arranged to travel in a curvilinear path in said metering opening.

3. An apparatus as defined by claim 2, characterized in that said fuel metering needle is fabricated of a material having a circular cross section and a metering zone, said metering zone provided by removing a portion of said material from a predetermined area of said fuel metering needle, said area having a relatively large radius.

4. An apparatus as defined by claim 2 or 3, characterized in that said shielding body and said metering opening are displaceable relative to said fuel metering needle by an adjusting device in accordance with operating parameters of said engine.

5. An apparatus as defined by claim 1, characterized in that said control section of said control body comprises a spherical shell, said spherical shell pivotable about said zone of said intake tube section, and said zone further having a flowthrough opening.

6. An apparatus as defined by claim 5, characterized in that said actuation section of said control body is disposed on said control section remote from said metering needle and arranged to extend perpendicular to said control section.

7. An apparatus as defined by claim 5, characterized in that said flowthrough opening in said spherical shell in said intake tube has a contour which determines the ratio between the rotational movement of said control body and the air quantity flowing therethrough.

8. An apparatus as defined by claim 7, characterized in that said flowthrough opening in said intake tube section has a contour such that a logarithmic ratio exists between said rotational movement of said control body and the quantity of air flowing therethrough.

* * * * *